US006782626B1

(12) United States Patent
Gibbs

(10) Patent No.: US 6,782,626 B1
(45) Date of Patent: Aug. 31, 2004

(54) APPARATUS AND METHOD OF ASSEMBLY OF FIXED BLADE KNIFE

(75) Inventor: Philip W. Gibbs, Camillus, NY (US)

(73) Assignee: Camillus Cutlery Co., Camillus, NY (US)

( * ) Notice: Subject to any disclaimer, the term of this patent is extended or adjusted under 35 U.S.C. 154(b) by 0 days.

(21) Appl. No.: 10/752,254

(22) Filed: Jan. 6, 2004

(51) Int. Cl.[7] ..... B26B 5/00
(52) U.S. Cl. ..... 30/342; 30/339; 30/340
(58) Field of Search ..... 30/339, 340, 342, 30/335, 513; 81/471; 16/406

(56) References Cited

U.S. PATENT DOCUMENTS

| | | | | |
|---|---|---|---|---|
| 57,677 | A | 9/1866 | Clayton | |
| 229,219 | A | 6/1880 | Wilson | |
| 465,138 | A | 12/1891 | Kelley | |
| 515,742 | A | 4/1894 | Bultzingslowen | |
| 630,675 | A | 8/1899 | Ferrall | |
| 1,030,321 | A | 6/1912 | Muller | |
| 1,420,342 | A * | 6/1922 | Richard | 279/95 |
| 2,544,563 | A | 4/1951 | Moehle | |
| 2,615,247 | A | 8/1952 | Waters | |
| 2,695,450 | A | 11/1954 | Platts | |
| 3,241,237 | A | 3/1966 | Eastman | |
| 4,233,737 | A | 11/1980 | Poehlmann | |
| 4,458,420 | A | 7/1984 | Davis | |
| 4,520,566 | A * | 6/1985 | Davis | 30/342 |
| 4,821,356 | A | 4/1989 | Finn | |
| 5,402,578 | A | 4/1995 | Whitman et al. | |
| 5,594,967 | A | 1/1997 | Morton et al. | |
| 5,711,079 | A | 1/1998 | Fischer et al. | |
| 6,408,525 | B1 | 6/2002 | Marttiini | |

* cited by examiner

*Primary Examiner*—Douglas D Watts
(74) *Attorney, Agent, or Firm*—George R. McGuire; Bond, Schoeneck & King, PLLC

(57) ABSTRACT

A fixed blade knife or bayonet having integral blade and tang portions and a handle having a cavity extending therethrough from distal to proximal ends. A slot is formed in the tang, extending from an open end at the terminal end of the tang to a closed end, with a narrower slot portion extending from the open end and adjoining a wider portion which extends to the closed end of the slot. A nut having a threaded bore is formed with a first cross dimension slightly smaller than the width of the wider slot portion and a second cross dimension, larger than and perpendicular to the first cross dimension. The nut is inserted laterally into the wider slot portion and the tang, with the nut carried therein, is inserted into the handle cavity, which has a cross sectional outline corresponding to that of the combined tang and nut. A screw is inserted into the bore which forms a portion of the cavity extending into the proximal end of the handle. This bore has portions of different diameters, forming a shoulder which is engaged by the head of the screw, whereby tightening of the screw draws the nut, and thereby the tang, toward the distal end of the handle, holding the blade/tang fixedly to the handle. The screw and/or nut may be easily replaced in the event of damage or breakage without requiring replacement or repair of the blade/tang or the handle.

17 Claims, 2 Drawing Sheets

APPARATUS AND METHOD OF ASSEMBLY OF FIXED BLADE KNIFE

BACKGROUND OF THE INVENTION

The present invention relates to knives and bayonets having integral blade and tang portions with a handle portion covering the tang and secured by a screw and nut. More particularly, the invention relates to improved means for incorporating a threaded fastener into a knife or bayonet to releasably secure an integral blade and tang in assembled relation with a handle.

U.S. Patent No. discloses a fixed blade knife wherein the head of a machine screw is placed in a slot formed in one end of a tang with a blade extending integrally from the opposite end. The threaded portion of the screw extends through a narrower portion of the slot. A stamping or pressing operation flattens the head of the screw to substantially the same thickness as the tang, an operation which, in effect, makes the screw physically integral with the tang. Although this arrangement represented an improvement in manufacturing technique over previous methods of securing an integral blade and tang to a handle piece, it has been found that under conditions of severe use, where high loads are placed on the blade and transmitted to the tang, the screw is subject to cracking or breaking. Because the screw head is essentially integral with the tang, a defective screw cannot be replaced, thus rendering the entire knife, with the possible exception of the handle piece, useless.

It is a principal object of the present invention to provide means for and methods of releasably retaining an integral knife blade and tang in assembled relation with a handle piece of a fixed blade knife or bayonet.

Another object is to provide a knife having a slotted tang extending from a blade wherein a two-piece threaded fastener is engaged with the tang and a handle in a manner which facilitates field repair in the event of failure of the fastener.

A further object is to provide a novel and improved fixed blade knife, which may be fitted for use as a bayonet, having a blade with integral tang and a handle piece which are releasably held in assembled relation by a two-piece threaded fastener, and methods of fabricating and assembling such knives, wherein damaged portions of the fastener may be easily replaced in the original blade-tang and handle piece.

Additional objects will in part be obvious and in part appear hereinafter.

SUMMARY OF THE INVENTION

In accordance with the foregoing objects, the invention contemplates a fixed blade knife comprising two parts, namely, an integral blade and tang, contiguous along a linear axis, formed from a single piece of stainless steel or other suitable metal, and a handle, preferably molded from a suitable plastic. The tang has a constant length, width and thickness, adjoining the blade at a stepped shoulder providing an abutment surface for the handle in the assembled relation of the two parts. At the end opposite its integral connection to the blade, termed the terminal end, a slot is cut into the tang, extending into the terminal end, symmetrical to the longitudinal axis of the tang. The slot includes a first portion, having a first width and extending into the terminal end for a first distance, and a second portion, extending having a second width, greater than the first width, from the first portion for a second distance.

The blade/tang and handle pieces are placed in assembled relation by passing the tang into a through opening in the handle, and are releasably retained in this relation by a two-piece threaded fastener, i.e., a machine screw and a nut. The nut has an outer surface which is cylindrical with opposite sides flattened to lie in planes spaced by a distance equal to or slightly less than the second width of the slot in the tang, permitting the nut to be laterally inserted into the second portion of the slot. The screw which mates with the threaded, through opening in the nut has a threaded portion of first diameter, equal to or slightly less than the first width of the slot, and a head of second diameter, larger than the first diameter. The handle piece has a through, longitudinal opening extending from a proximal to a distal end. The cross-sectional shape of the opening at the distal end is circular with rectangular portions on opposite sides (this shape being termed for convenience a "keyhole" shape) and extends in this shape for a distance at least equal to the length of the tang. The keyhole shaped opening is adjoined by a first, cylindrical opening having a diameter equal to or slightly less than the first diameter and a length less than the length of the threaded portion of the screw. The first cylindrical opening is adjoined by a second, cylindrical opening having a diameter equal to or slightly less than the second diameter, thus being of a size to contain the screw head.

In assembly, the nut is placed in the second portion of the tang slot with the threaded opening in the nut substantially aligned with the longitudinal axis of the slot; the flat sides of the nut will be closely retained between opposing sides of the slot. The terminal end of the tang is then inserted into the distal end of the opening in the handle piece, where the rounded sides of the nut and marginal portions along each side of the tang will be closely surrounded by the keyhole shaped opening. The tang is advanced until the distal end of the handle piece contacts the stepped shoulder where the blade and tang are integrally joined, with the entire tang being positioned within the handle piece. The threaded end of the screw is then advanced through the cylindrical openings in the proximal end of the handle and threaded into the nut. A screwdriver or other suitable tool is used to tighten the screw, thereby retaining the blade/tang and handle pieces in assembled relation. If either or both parts of the threaded fastener become damaged or broken, the screw is removed, the blade/tang and handle disassembled, and the damaged portion(s) discarded and replaced, followed by assembling the pieces again as described above.

The foregoing and other features of structure and steps of fabrication and assembly of the invention will be more readily understood and fully appreciated from the following detailed disclosure, taken in conjunction with the accompanying drawings.

DETAILED DESCRIPTION

Figure 1:
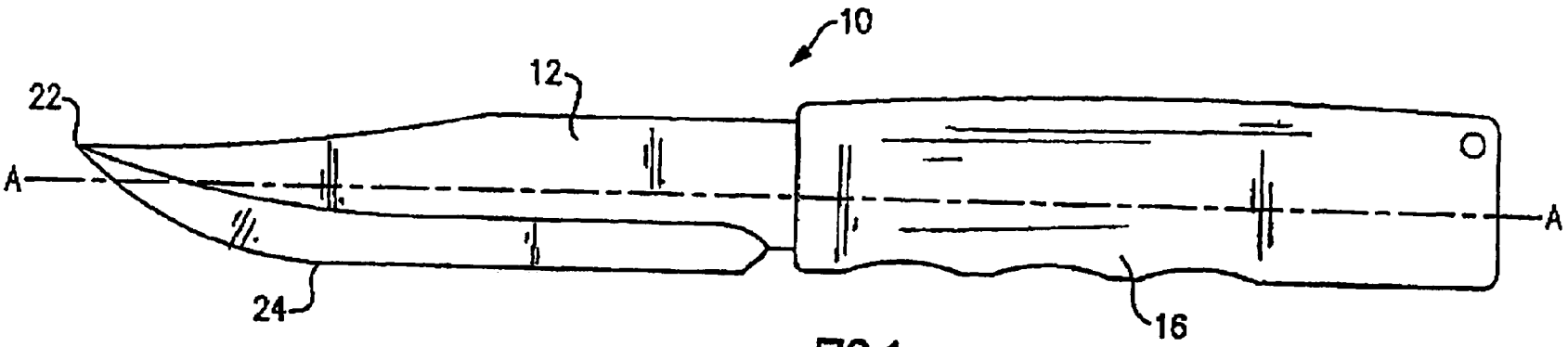
FIG. 1 is a side elevational view of the knife with all parts in assembled relation.
Figure 2:
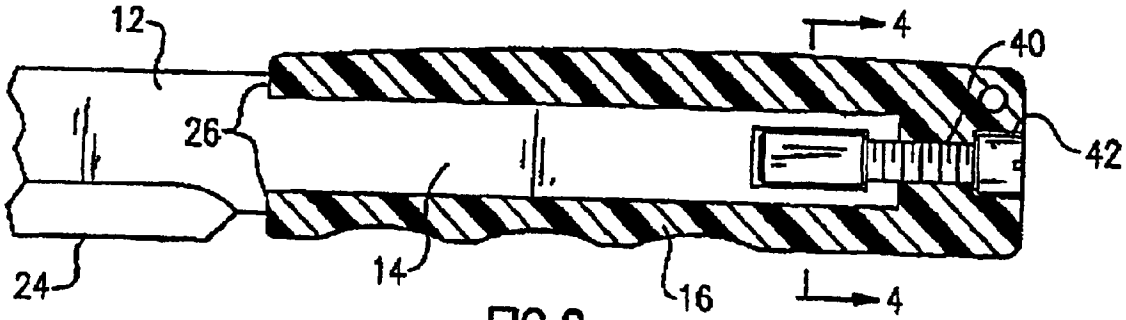
FIG. 2 is the same view as FIG. 1 with the handle piece in vertical section.

Although the implement of the invention is shown and described as a fixed blade knife it will be readily understood that, by providing conventional attachment means, the implement may be mounted upon a rifle or similar weapon and utilized in the manner of a bayonet. The illustrated version of the knife, denoted generally by reference numeral 10, comprises an integral blade 12 and tang 14 piece and handle piece 16, and a two-piece threaded fastener, illustrated in the form of nut 18, having threaded, through bore 19, and machine screw 20. Blade 12, having pointed, distal end 22 and cutting edge 24, is formed integrally with tang 14 from a single piece of suitable metal alloy. Stepped shoulders 26 are formed at the junction of blade 12 and tang 14. Both blade 12 and handle 16 may take any form suitable to the intended use of the knife and are substantially aligned along a mutual, longitudinal axis in the assembled relation of the pieces.

A slot is formed in tang 14, extending into terminal end 28 for a first distance D1 having a width W1, and for a second distance D2, greater than D1, having a width W2, greater than W1. Nut 18 has a cylindrical outer surface having a diameter d1 with opposite sides 30, 30' flattened to lie in parallel planes spaced by distance d2, equal to or slightly less than width W2 of the tang slot. Screw 20 has a threaded portion 32 for engagement with the threaded bore 19 of nut 18, as well as head portion 34. As seen in FIG. 3, opening 36 extends into the distal end of handle piece 16 and has a cylindrical central portion of diameter d1, or slightly greater, and rectangular portions having a width equal to or slightly greater than thickness T of tang 14 on opposite sides of the cylindrical portion, such shape being termed for convenience "keyhole" shaped. Opening 36 extends with the keyhole shaped cross section from the distal end of handle piece 16 to an inner end 38 near the proximal end of handle piece 16 where it merges with cylindrical opening 40, having diameter equal to or slightly greater than the diameter of threaded portion 32 of screw 30. Cylindrical opening 40 merges with cylindrical opening 42 which extends to the proximal end of handle piece 16 and has a diameter at least large enough to accommodate head 34.

Figures 1A, 3, 4:
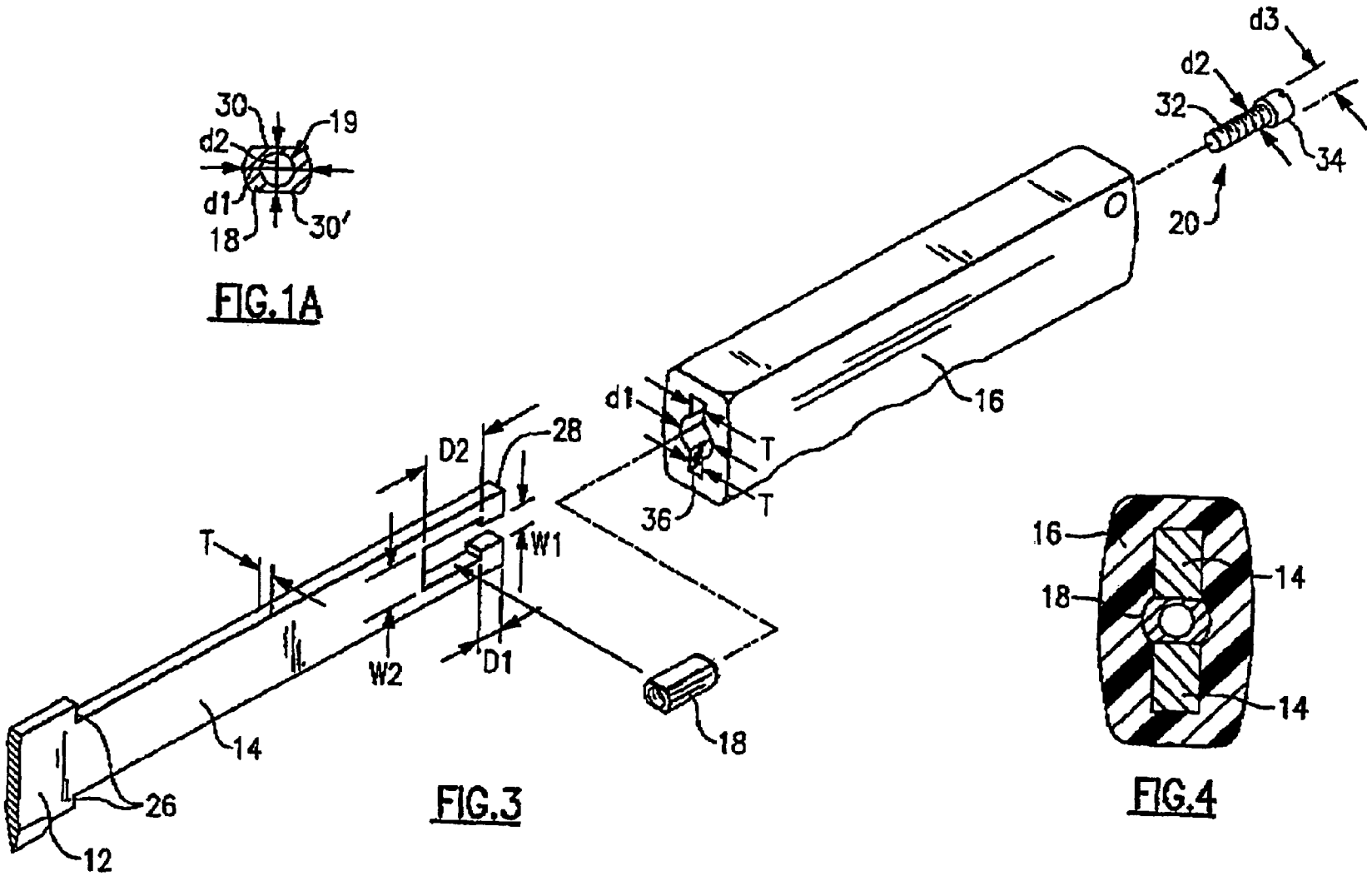
FIG. 1A is an end elevational view of one of the elements of FIG. 1.
FIG. 3 is an exploded perspective view of the knife.
FIG. 4 is an elevational view in cross section on the line 4—4 of FIG. 2.

The parts are assembled, as indicated in FIG. 1, by moving nut 18 laterally into the portion of the tang slot of width W2, i.e., a dimension equal to or slightly greater than the distance between planar sides 30, 30' of the nut. Terminal end 28, with nut 18, is inserted into keyhole shaped opening 36 and advanced until shoulders 26 contact the distal end of handle piece 16, which may be substantially when terminal end 28 of tang 14 contacts the inner end of opening 36, i.e., tang 14 has a length substantially equal to or slightly less than the axial length of the keyhole cross section opening in handle piece 16. Threaded portion 32 of screw 20 is then inserted through openings 42 and 40 to threadedly engage nut 18. Upon tightening of screw 20, using a screwdriver or other appropriate tool, the blade/tang piece 12/14 is securely assembled with handle piece 16. Should screw 20, and/or nut 18, become damaged or broken, the parts may be disassembled and a new screw and/or nut used in reassembling the knife.

What is claimed is:

1. A fixed blade knife comprising:

a) a blade and tang piece wherein said blade and tang extend from an integral junction to respective terminal ends along a first longitudinal axis;

b) a handle piece having a second longitudinal axis, distal and proximal ends, and a through, longitudinal opening, said opening having a first portion of keyhole shape, with a cylindrical central portion and rectangular portions on opposite sides, extending into said distal end for a first portion of the length of said handle piece, and a second portion of cylindrical shape extending into said proximal end to adjoin said keyhole shape;

c) a slot extending into said terminal end of said tang substantially along said axis, said slot having a first portion extending from said terminal end for a first distance having a first width, and a second portion extending from said first portion for a second distance having a second width;

d) a nut having a threaded bore with a central axis, and an external surface having two opposite sides formed in a cylindrical plane and two opposite, planar surfaces spaced by a distance equal to or slightly smaller than said second width of said tang slot said nut having an axial length less than said second distance; and e) a screw having a threaded portion for engagement with said bore and a head portion having a maximum cross-dimension larger than the diameter of said second portion of said handle opening.

2. The knife of claim 1 wherein said first and second longitudinal axes are substantially coaxial.

3. The knife of claim 1 wherein said nut has an axial length which is at least 90% of said second distance of said slot.

4. The knife of claim 1 wherein said second portion of said handle portion through opening includes a first section of diameter equal to or slightly larger than the diameter of said screw threaded portion, and a second section of diameter larger than said maximum cross-dimension of said screw head portion, said first section extending from said first portion of said handle portion through opening to merge with said second section and said second section extending from said first section to said proximal end of said handle piece.

5. The knife of claim 1 wherein said tang has a predetermined, uniform thickness and said planar surfaces of said nut have widths at least as great as said thickness.

6. The knife of claim 1 wherein said tang has an axial length which is at least 90% of said first portion of the length of said handle piece.

7. The knife of claim 6 wherein said tang has an axial length which is substantially as great as said first portion of the length of said handle piece.

8. The knife of claim 7 wherein said blade is wider than said tang at the junction thereof, forming a pair of stepped shoulders limiting the extent of axial advance of said tang into said handle through opening.

9. The method of fabricating and assembling a fixed blade knife comprising:

a) forming an integral blade and tang extending along a common, first longitudinal axis from a mutual junction to respective terminal ends;

b) forming a slot extending into said tang terminal end, said slot having first and second portions with a common, first central axis extending linearly parallel to said first longitudinal axis, said first portion extending from an open end at said tang terminal end to a first junction with said second portion, and said second portion extending from said first junction to a closed end, said first and second portions having respective first and second, minimum widths at said first junction, said second width being larger than said first width;

c) forming a handle having proximal and distal ends, and a cavity extending from a first open end at said distal end to a second junction with a bore extending from said second junction to a second open end at said proximal end, said bore having a second central axis;

d) forming a nut having a threaded bore with a second longitudinal axis, a first cross dimension slightly less than said second width, allowing said first threaded fastener to be moved laterally into said second portion of said slot, and a second cross dimension perpendicular to said first cross dimension and larger than said second width;

e) placing said nut in said second portion of said slot with said second longitudinal axis coaxial with said first central axis;

f) advancing said tang terminal end, with said nut positioned in said second portion of said slot, into said first open end of said cavity until said tang terminal end reaches said second junction with said second longitudinal axis coaxial with said second central axis;

g) inserting a screw having external threads matable with said threaded bore into said second open end of said cavity; and h) advancing said screw through said cavity bore to engage said threaded bore and tightening said screw.

10. The method of claim 9 and further comprising forming said bore with a first portion extending from said second junction to a second portion which extends to said handle proximal end, said first and second bore portions having respective first and second diameters, said second diameter being larger than said first diameter.

11. The method of claim 10 wherein said screw has a threaded stem portion having a diameter not more than said first diameter, and a head portion having a maximum cross dimension not more than said second diameter, whereby said stem portion may be advanced through said first bore portion while said head portion remains in said second bore portion.

12. The method of claim 11 wherein said second bore portion and said head portion have substantially equal axial lengths, whereby said head portion is substantially flush with said proximal end of said handle when said stem is fully engaged with said threaded bore.

13. The method of claim 9 wherein each of said first and second portions of said slot have substantially constant widths over their respective axial lengths.

14. The method of claim 13 wherein said nut has an axial length slightly less than the axial length of said first slot portion.

15. The method of claim 14 wherein the axial length of said first slot portion is less than one-half the axial length of said second slot portion.

16. The method of claim 9 wherein said tang portion has an axial length substantially equal to the axial length of said first cavity portion.

17. The method of claim 16 wherein said first slot portion has a substantially constant cross sectional outline throughout its axial length, said outline conforming substantially to the cross sectional outline of said tang portion with said nut located in said first slot portion.

* * * * *